US006116635A

United States Patent [19]

Rigal

[11] Patent Number: 6,116,635

[45] Date of Patent: Sep. 12, 2000

[54] DEVICE FOR RETAINING A BOOT ON A GLIDING BOARD

[75] Inventor: Jean-Pierre Rigal, La Balme de Sillingy, France

[73] Assignee: Salomon S.A., Metz-Tessy, France

[21] Appl. No.: 09/236,674

[22] Filed: Jan. 26, 1999

[30] Foreign Application Priority Data

Jan. 30, 1998 [FR] France ..... 98 01266

[51] Int. Cl.[7] ..... A63C 9/00

[52] U.S. Cl. ..... 280/618; 280/14.2

[58] Field of Search ..... 280/14.2, 611, 280/619, 624, 620, 607, 621, 622, 623, 625, 634, 636, 11.36, 618; 36/117.1, 117.2, 117.3, 118.2, 118.3, 118.4, 118.7, 118.8, 118.9, 117.8, 115

[56] References Cited

U.S. PATENT DOCUMENTS

| | | | |
|---|---|---|---|
| 3,931,982 | 1/1976 | Kubelka | 280/11.35 D |
| 4,979,760 | 12/1990 | Derrah | 280/607 |
| 5,412,883 | 5/1995 | Wulf et al. | 36/50.5 |
| 5,647,148 | 7/1997 | Meiselman | 36/115 |
| 5,727,797 | 3/1998 | Bowles | 280/14.2 |
| 5,815,953 | 10/1998 | Kaufman et al. | 36/118.3 |
| 5,909,886 | 6/1999 | Tugutaka et al. | 280/14.2 |
| 5,918,897 | 7/1999 | Hansen et al. | 280/611 |
| 5,967,531 | 10/1999 | Saillet | 280/11.36 |
| 5,971,407 | 10/1999 | Zemke et al. | 280/14.2 |
| 5,997,027 | 12/1999 | Jungkind | 280/617 |
| 6,026,596 | 2/2000 | Seidel | 36/117.4 |

FOREIGN PATENT DOCUMENTS

| | | |
|---|---|---|
| 0838248 | 4/1998 | European Pat. Off. . |
| 19603790 | 4/1997 | Germany . |
| 29700738 | 7/1997 | Germany . |
| WO97/28858 | 8/1997 | WIPO . |

*Primary Examiner*—Paul N. Dickson
*Assistant Examiner*—Bridgit Avery
*Attorney, Agent, or Firm*—Greenblum & Bernstein, P.L.C.

[57] ABSTRACT

A device for retaining a boot on a gliding board and a gliding board equipped with such device. The device has a base and a rear support element articulated on the base along a substantially transverse journal axis of the device. The rear support element has two parts, an arch articulated on the base and a collar affixed to the arch, the collar having a greater rigidity than the arch, the arch cooperating with an arch/a bow of the base to limit a front-to-rear articulation movement of the rear support element with respect to the base.

6 Claims, 2 Drawing Sheets

21
13
1
4
29
12
8
30
Y
6
2
3
20
5
9
10
11
Y'
7

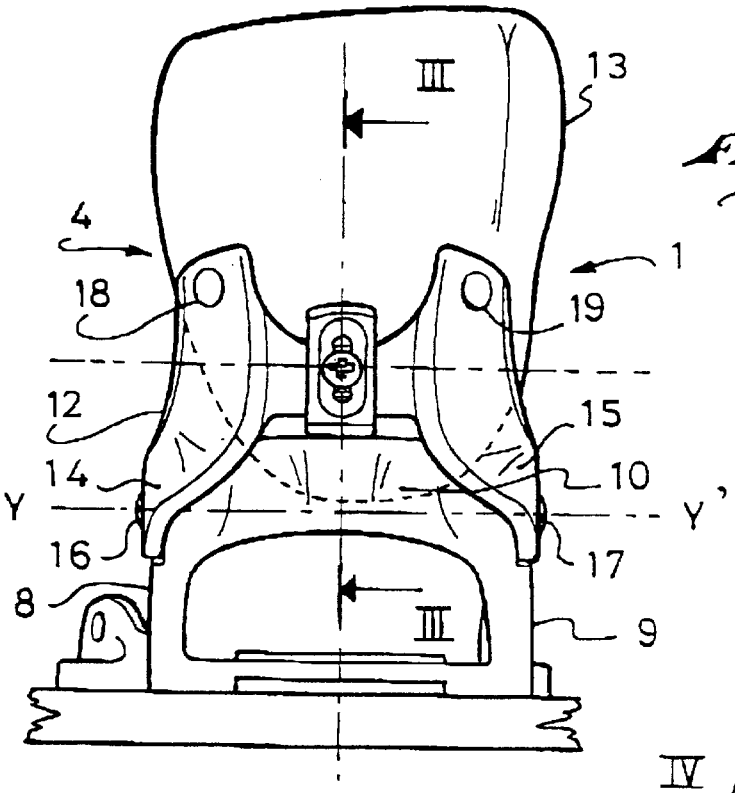
Fig: 2
Fig: 3
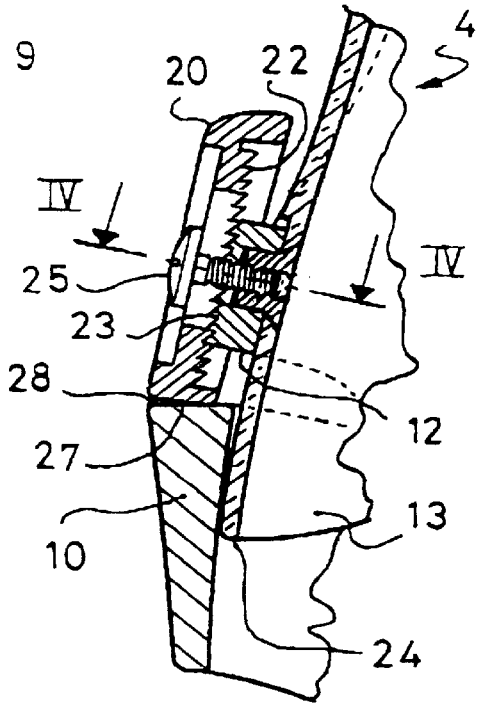
Fig: 4
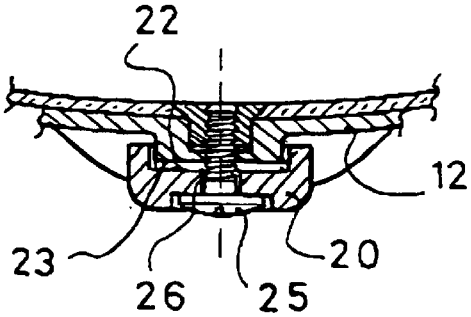

DEVICE FOR RETAINING A BOOT ON A GLIDING BOARD

BACKGROUND OF THE INVENTION

1. Field of the Invention

The present invention relates to the field of devices for retaining a boot on a gliding board, and relates in particular to a device for a board adapted to snowboarding.

2. Description of Background and Relevant Information

Among the known devices of the aforementioned type, some are provided to retain a flexible boot and have the following structure.

The device has a base and a rear support element, the base having a bed that extends between a front end and a rear end along a longitudinal direction of the device, the base having two lateral edges affixed to the bed, the edges being connected together on the side of the rear end of the bed by an arch, the rear support element being journaled on the base along a substantially transverse journal axis of the device. The boot is retained on the device, for example, by means of straps.

On this type of device, the rear support element, which extends upon contact of the boot at the level of the lower part of a user's leg, has a flexibility which hinders the steering accuracy.

The lack of accuracy is especially noticeable during a rear support with the lower part of the leg, the support element bending overly, especially at the level of its upper end.

To obtain a sufficient steering accuracy, prior art has proposed stiffening the rear support element by means, such as reinforcements. Steering accuracy has improved, but the device has become so uncomfortable that steering is painful for the user.

SUMMARY OF THE INVENTION

An object of the invention is to provide a flexible boot retaining device which allows an accurate steering and which offers a sufficient level of comfort so as not to hinder the user.

A device for retaining a boot on a gliding board according to the invention has a base and a rear support element, the base having a bed that extends between a front end and a rear end along a longitudinal direction of the device, the base having two lateral edges affixed to the bed, the edges being connected together on the side of the rear end of the bed by an arch, the rear support element being journaled on the base along a substantially transverse articulation axis of the device.

The rear support element of the invention has two parts, an arch/bow journaled on the base and a collar affixed to the bow, the collar having a greater rigidity than the arch/bow, and the bow cooperating with the arch to limit a front-to-rear journal movement of the rear support element with respect to the base.

The structure of the rear support element is such that, during steering, the latter is very slightly deformed in the area of the bow while remaining undeformable in the area of the collar. The result is that the device allows an accurate steering and offers a sufficient level of comfort so as not to hinder a user.

The invention also relates to a board provided with at least one such device.

BRIEF DESCRIPTION OF DRAWINGS

Other characteristics and advantages of the invention will be better understood with reference to the following description and the attached drawings showing, by way of non-limiting example, how the invention can be embodied, and in which:

FIG. 2 is a rear view of the device of FIG. 1;

FIG. 3 is a cross-section taken along the line III—III of FIG. 2;

FIG. 4 is a cross-section taken along the line IV—IV of FIG. 3.

DETAILED DESCRIPTION OF THE INVENTION

Figure 1:
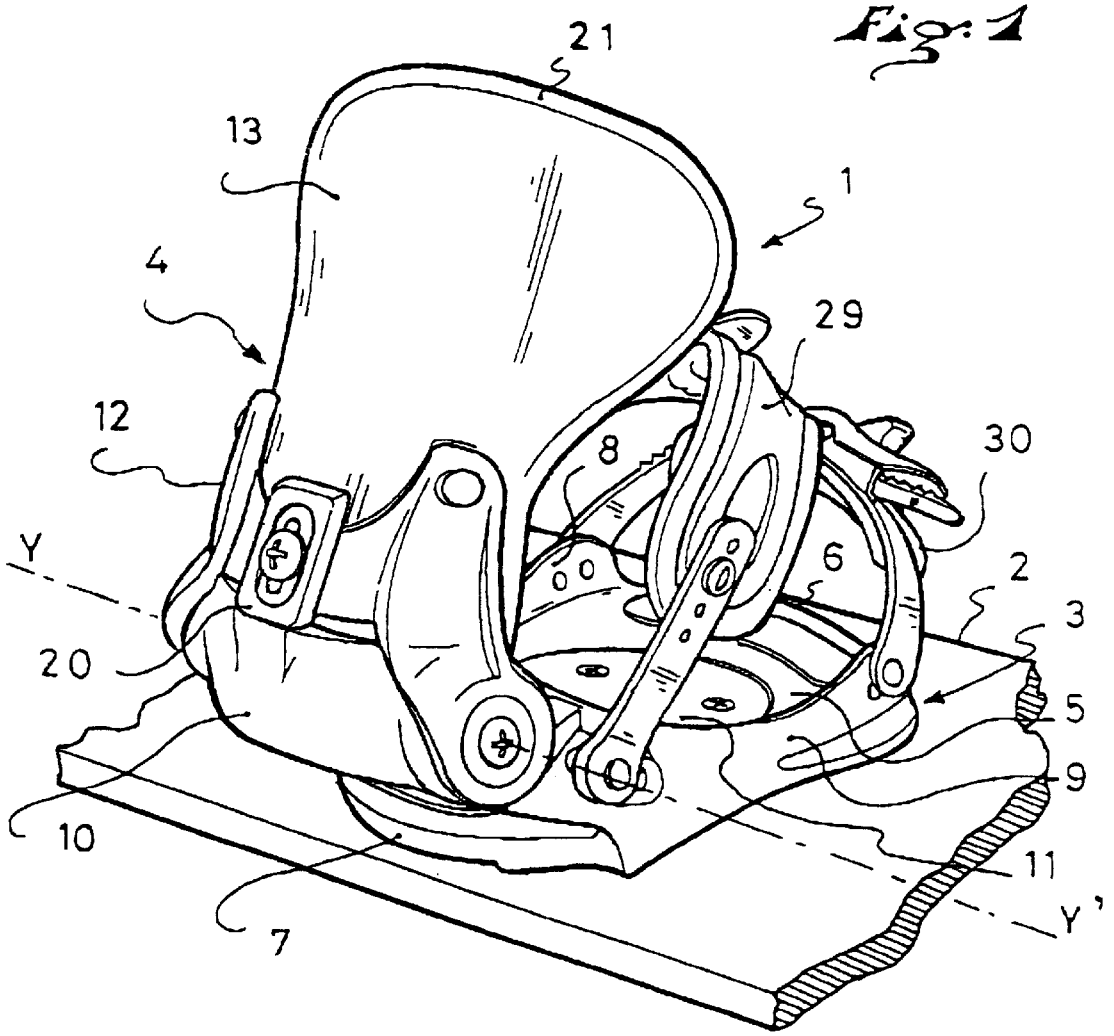
FIG. 1 is a rear perspective view of a retaining device according to the invention.

A preferred embodiment of the invention is described hereinafter with reference to FIGS. 1–4.

As can be understood from FIG. 1, for example, a device 1 is provided to retain a boot on a gliding board 2; the boot is not shown for reasons of convenience.

The device 1 has a base 3 and a rear support element 4. The base 3 had a bed 5 that extends between a front end 6 and a rear end 7 along a longitudinal direction of the device 1.

It must be understood that the longitudinal direction of the device 1 is a direction that is substantially the same as the longitudinal direction of the boot when the latter is retained on the device 1.

The base 3 has two lateral edges 8, 9 which are provided to retain the boot along a transverse direction of the device 1. It must be understood that the transverse direction is a direction that is substantially perpendicular to the longitudinal direction, and substantially parallel to the bed 5.

An arch/bow 10 connects the edges 8, 9 on the side of the rear end 7 of the bed 5.

The arch/bow 10 is an edge that is situated towards the rear of the device 1 and is raised with respect to the bed 5.

Preferably, the bed 5, the edges 8, 9 and the arch/bow 10 form a single piece, which allows manufacturing the base 3 according to a simple method For example, the base 3 can be made with a plastic or metallic material introduced in a mold, such as a glass fiber reinforced polyamide.

The base 3 is retained on the board 2 by any means known to one skilled in the art, such as a disk 11, for example, itself affixed to the board 2 by any appropriate means.

The boot is removably retained on the base 3 by a means shown in the form of straps 29, 30 which are also well known to one skilled in the art.

The straps 29, 30 hold the boot such that the sole is pressed against the bed 5, and that the heel is pressed against the arch/bow 10 or located near the arch/bow 10.

The rear support element 4 has two distinct parts: an arch 12 and a collar 13.

As better understood from FIG. 2, the arch 12 of the rear support element 4 has two arms 14, 15 located in the extension of the lateral edges 8, 9, respectively. The arch 12 is articulated on the arch/bow 10 along a substantially transverse axis Y–Y' of the device 1.

It must be understood that the axis Y–Y' is oriented in the transverse direction of the device 1.

The articulation of the arch 12 on the arch/bow 10 is obtained by a means shown in the form of two screws 16, 17, substantially coaxial, according to a technique well known to one skilled in the art. The collar 13 is affixed to the arch 12 by a means shown in the form of rivets, for example, two rivets 18, 19 located respectively on both sides of the rear support element 4.

As better understood from FIG. 1, an adjustable abutment 20 limits a front-to-rear articulation movement of the rear support element 4 with respect to the base 3.

The front-to-rear articulation movement must be understood as being a movement during which an upper end 21 of the collar 13 is distanced from the front end 6 of the bed 5. The upper end 21 is common to the collar 13 and to the rear support element 4.

The abutment 20 is seen in cross-section in FIGS. 3 and 4.

As seen in FIG. 3, the abutment 20 has a toothed section 22 provided to cooperate with a toothed section 23 of the arch 12, such that the abutment 20 is attached to the arch 12 in a selected position.

It is possible to b ring the abutment 20 closer to or to distance it from a lower end 24 of the collar 13 by displacing the sectors 22 and 23 with respect to one another.

To this end, it suffices to unscrew a screw 25 for maintaining the abutment 20 on the rear support element 4, to position the sectors 22, 23 with respect to one another, then to tighten the screw 25.

As understood from FIG. 4, teeth from the sectors 22 and 23 are always engaged regardless of the position of the abutment 20 with respect to the arch 12. Indeed, the screw 25 extends through a slot 26 of the abutment 20 at the level of the sector 22, the width of the slot 26 being smaller than that of the sector 22, the sectors 22 and 23 having a similar width. Of course, the width of the sectors 22 and 23 extends substantially parallel to the transverse axis Y–Y'.

As understood from FIG. 3, for example, the abutment 20 limits the front-to-rear articulation movement of the rear support element 4 with respect to the base 3 by the contact of a surface 27 of the abutment 20 with a surface 28 of the arch/bow 10.

In this case, the device 1 is in a position of use which allows steering the board 2. In the position of use, which corresponds to an end position of the rear support element 4 in the front-to-rear articulation direction, the arch 12 and the arch/bow 10 are located further back than the collar 13 on the device 1.

Preferably, as understood from FIG. 2, the collar 13 extends at least partially in front of the arch/bow 10, if the longitudinal direction is used as a reference.

The materials and dimensions of the arch 12 and of the collar 13 are defined such that the collar 13 has a greater rigidity than the arch 12.

For example, the collar 13 can be manufactured with glass fiber fabric webs embedded in a polypropylene matrix. The collar 13 is substantially undeformable under the action of forces exerted by the user during steering.

As for the arch 12, it is preferably made by molding a polyurethane loaded with glass fiber. The arch is very lightly deformable under the action of the forces exerted by the user during steering.

Thus, when the user biases the collar 13 towards the rear of the device 1 by taking supports with the lower part of the leg, the rear support element 4 is very lightly deformed near the arch/bow 10.

The deformation is sufficiently minor so that the user can take firm S supports. The deformation is also sufficient so that the taking of support is absorbed and does not cause pain in the legs.

The structure of the device 1 according to the invention allows the rear support element 4 to deform itself in an area distanced from its upper end 21.

The rigidity of the collar 13 allows the user to keep a good contact with the rear support element 4 at the level of the lower part of the leg.

Thus, steering is both accurate and comfortable.

The invention is achieved according to all the techniques known to one skilled in the art.

The invention is not limited to the previously described embodiment, and it encompasses all the technical equivalents that are encompassed by the scope of the following claims.

In particular, the use of other construction materials can be provided.

The collar 13 can have reinforcements. The structure of the abutment 20 can be different. The journal axis Y–Y' can be located elsewhere on the device. The arch 12 could be affixed to the base 3 in a fixed position of use, i.e., with no articulation.

Also, the edges 8, 9 can be non-projecting with respect to the bed 5, in which case the edges 8, 9 are constituted by the thickness of the bed 5.

Furthermore, retaining the boot on the device 1 can be done by an automatic fitting system, excluding all straps.

The instant application is based upon French patent application No. 98 01266, filed Jan. 30, 1998, the disclosure of which is hereby expressly incorporated by reference thereto in its entirety, and the priority of which is hereby claimed under 35 USC 119.

What is claimed is:

1. A device for retaining a boot on a gliding board, the device comprising a base and a rear support element, the base having a bed that extends between a front end and a rear end along a longitudinal direction of the device, the base having two lateral edges affixed to the bed, the lateral edges being connected together on the side of the rear end of the bed by an arch/bow, the rear support element being articulated on the base along a substantially transverse journal axis of the device, wherein the rear support element comprises two parts, an arch articulated on the base and a collar affixed to the arch, the collar having a greater rigidity than the arch, the arch cooperating with the arch/bow to limit a front-to-rear articulation movement of the rear support element with respect to the base.

2. A device according to claim 1, comprising at least one adjustable abutment to limit the front-to-rear articulation movement of the rear support element with respect to the base.

3. A device according to claim 2, wherein the abutment is attached to the arch.

4. A device according to claim 1, wherein the arch and the arch/bow are located farther back than the collar on the device when the rear support element is in an end position in the front-to-rear articulation direction.

5. A device according to claim 1, wherein the arch is manufactured with a polyurethane loaded with glass fiber, and wherein the collar is manufactured with fabric webs of glass fiber embedded in a polypropylene matrix.

6. A gliding board equipped with a device for retaining a boot on the board, the device comprising a base and a rear support element, the base having a bed that extends between a font end and a rear end along a longitudinal direction of the device, the base having two lateral edges affixed to the bed, the edges being connected together on the side of the rear end of the bed by an arch/a bow, the rear support element being articulated on the base along a substantially transverse journal axis of the device, wherein the rear support element of the device comprises two parts, an arch articulated on the base, and a collar affixed to the arch, the collar having a greater rigidity than the arch, the arch cooperating with the arch/bow to limit a front-to-rear articulation movement of the rear support element with respect to the base.

* * * * *